United States Patent [19]

Fukuichi

[11] 4,110,969

[45] Sep. 5, 1978

[54] DIGITAL ELECTRONIC ALARM TIMEPIECE

[75] Inventor: Takuro Fukuichi, Tokyo, Japan

[73] Assignee: Kabushiki Kaisha Daini Seikosha, Japan

[21] Appl. No.: 776,892

[22] Filed: Mar. 11, 1977

[30] Foreign Application Priority Data

Mar. 11, 1976 [JP] Japan ..... 51/26286

[51] Int. Cl.[2] ..... G04B 23/12

[52] U.S. Cl. ..... 58/57.5; 58/23 R; 58/39.5; 58/21.15; 58/85.5

[58] Field of Search ..... 58/21.15, 38 R, 57.5, 58/16 R, 16 D, 19 R, 23 R, 85.5, 39.5, 35 R, 35 W

[56] References Cited

U.S. PATENT DOCUMENTS

| | | | |
|---|---|---|---|
| 3,405,518 | 10/1968 | Patrick et al. | 58/21.15 X |
| 3,664,116 | 5/1972 | Emerson et al. | 58/38 R X |
| 3,788,059 | 1/1974 | Spadini | 58/57.5 X |
| 3,834,153 | 9/1974 | Yoda et al. | 58/57.5 X |

*Primary Examiner*—Ulysses Weldon

*Attorney, Agent, or Firm*—Robert E. Burns; Emmanuel J. Lobato; Bruce L. Adams

[57] ABSTRACT

A digital electronic alarm timepiece comprising an oscillator circuit for generating a signal, frequency dividing means, time counting circuit means, alarm time memory counting means, alarm sound signal generating means and a coincidence circuit for activating the alarm sound signal generating means when coincidence occurs between the time of the alarm time memory counting means and the time of the time counting circuit means, has manually operable switching means for activating the alarm sound signal generating means independently of the coincidence circuit. The switching means comprises four individual switches which can be selectively actuated in different combinations to amend the count of the time counting circuit means, to set the time of the alarm time memory counting means and to activate the alarm sound signal generating means.

2 Claims, 2 Drawing Figures

DIGITAL ELECTRONIC ALARM TIMEPIECE

FIELD OF INVENTION

The present invention relates to digital electronic alarm timepieces and in particular to means for activating alarm sound generating means at any time besides the preset alarm time.

BACKGROUND OF INVENTION

A conventional digital electronic alarm timepiece has time counting circuit means for counting the frequency-divided output of an oscillator to provide a time signal and alarm time memory counting means for setting an alarm time. A coincidence circuit activates alarm sound generating means when coincidence occurs between the time signal of the time counting circuit means and the alarm time set by the alarm time memory counting means. Thus the alarm sound occurs only when the preset alarm time and the current time correspond to each other.

This would cause no inconvenience if the alarm sounds of all digital electronic alarm timepieces were the same. However since the alarm sounds produced by digital electronic alarm watches vary considerably the purchaser of a watch may wish to hear the alarm sound of various watches before making his purchase. In this case it is troublesome for the supplier to demonstrate the difference in the alarm sounds of the watches being considered by the purchaser since he must reset the alarm time of each watch so as to make the alarm time coincide with the current time in order to obtain the alarm sound.

SUMMARY OF INVENTION

It is an object of the present invention to overcome the insufficiencies and disadvantages of conventional digital electronic alarm timepieces by providing an electronic alarm timepiece which is capable of producing the alarm sound discretionarily without requiring the resetting of the alarm time memory counting circuit.

It is a further object of the present invention to provide for the discretionary sounding of the alarm signal of an electronic timepiece without increasing the cost of the timepiece. This is achieved by using a combination of the same switches that are used in normal switching operations such as time display, correcting the time signal and setting the alarm time so that no additional switches are required.

In accordance with a preferred embodiment of the invention an electronic alarm timepiece is provided with switching means comprising a plurality of switches which are operable in selected different combinations to amend the count of alarm time memory counting circuit means to set an alarm time, to amend the count of time counting circuit means to correct the time signal and to activate the alarm sound generating means of the timepiece so as to check or demonstrate the sound produced whenever desired and without requiring coincidence between the current time signal and the time for which the alarm is set.

BRIEF DESCRIPTION OF DRAWINGS

The nature, objects and advantages of the invention will be more fully understood from the following description of a preferred embodiment shown by way of example in the accompanying drawings in which.

DESCRIPTION OF PREFERRED EMBODIMENT

Figure 1:
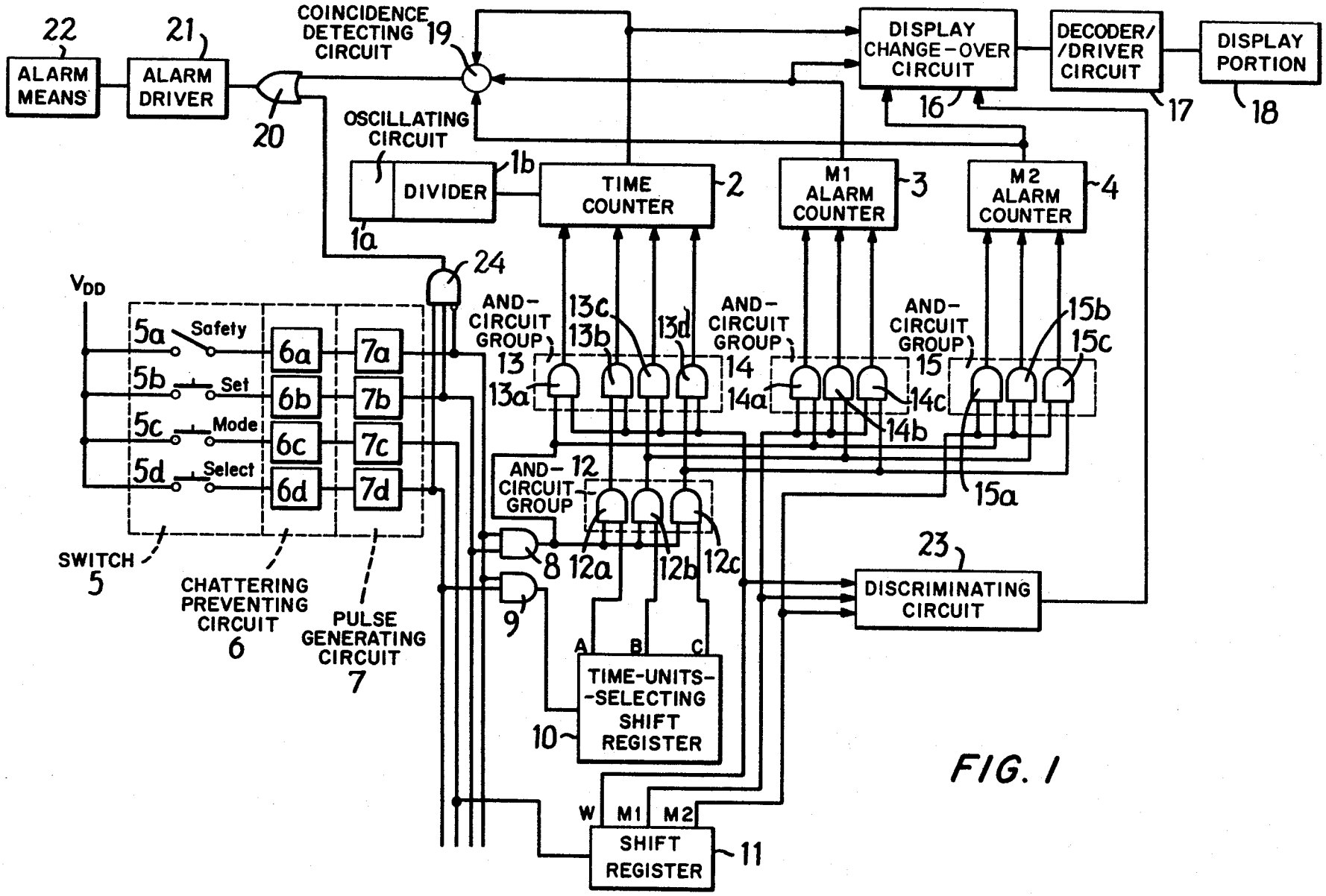
FIG. 1 is a basic circuit diagram of one embodiment of the present invention and FIG. 2 is a time chart illustrating the operation of part of the circuitry shown in FIG. 1.

As shown in FIG. 1 the circuitry of a digital electronic alarm timepiece comprises an oscillator circuit 1*a* for producing a standard signal. The output of the oscillator circuit 1*a* is divided by a frequency-divider 1*b*, the output of which is fed to a time counter 2 and divided into time units of a second, minute, hour, day or the like which are suitable for time display. In order to set the alarm time there are provided alarm time memory counters 3 and 4 which are hereinafter referred to as the $M_1$ and $M_2$ counter respectively. The outputs of counters 2, 3 and 4 are connected to a display change-over circuit 16, the output of which is connected through a decoder driver 17 to digital display means 18. The contents of the counters 2, 3 and 4 can thus be selectively displayed.

Means for selectively controlling the display and for resetting counters 2, 3 and 4 to correct the current time signal and to set alarm times includes a switch group 5 which is shown as comprising four individuals switches 5*a*, 5*b*, 5*c* and 5*d*. One terminal of the switch group 5 is connected to the positive potential (VDD) of a power source which is usually a battery. The other terminal of the switch group 5 is connected through a chatter preventing circuit 6 to a pulse generating circuit group 7. The circuit group 7 comprises four circuits 7*a*, 7*b*, 7*c* and 7*d* of which circuits 7*b*, 7*c* and 7*d* are pulse generating circuits which produce a pulse having a fixed pulse width when the corresponding switch of switch group 5 is closed. The circuit 7*a* does not produce a pulse having a fixed width but keeps the positive potential VDD when the switch 5*a* is closed to ON position and keeps the opposite negative potential when the switch 5*a* is in OFF position.

The outputs of circuits 7*a* and 7*b* are fed to the input terminals of an AND circuit 8 and the outputs of circuits 7*a* and 7*d* are fed to the input terminals of an AND circuit 9. The output of the pulse generating circuit 7*c* is fed to the input of a channel selecting shift register 11. The output of the AND circuit 8 is connected to one input terminal of each of the AND circuits of an AND circuit 12, to one input terminal of an AND circuit 13*a* of AND circuit group 13, to one input terminal of an AND circuit 14*a* of AND circuit group 14 and to one input terminal of an AND circuit 15*a* of AND circuit group 15.

The output of the AND circuit 9 is fed to the input of a time unit selecting shift register 10 having three outputs A, B and C. A signal is produced from one of the three outputs of the shift register according to the number of input pulses supplied by the AND circuit 9.

The three outputs of the shift register 10 are respectively connected to the other input terminals of AND circuits 12*a*, 12*b* and 12*c*. The output of AND circuit 12*a* is connected to one input terminal of AND circuit 13*b*. The output of AND circuit 12*b* is connected to one input terminal of each of AND circuits 13*c*, 14*b* and 15*b*. The output of AND circuit 12*c* is connected to one input terminal of each of AND circuits 13*d*, 14*c* and 15*c*.

The shift register 11 generates signals from three outputs W, $M_1$ and $M_2$ in turn according to the number of pulses supplied to the input of the shift register from the pulse generating circuit 7*c* under control of switch 5c. The output W of the shift register 11 is connected to the other input terminals of all of the AND circuits of AND circuit group 13. The output $M_1$ is connected to the other input terminal of each of the AND circuits of AND circuit group 14. The output $M_2$ of the shaft register is connected to the other input terminal of each of the AND circuits of AND circuit group 15. Coincidentially the outputs of all of the outputs W, $M_1$, and $M_2$ are fed to a discriminating circuit 23 which discriminates the output terminal which generates the output signal. The output of the discriminating circuit 13 is fed to the display change-over circuit 16 which selectively displays the desired channels namely a time display W, a first alarm time memory content display $M_1$ and a second alarm time memory content display $M_2$ by the output signal from the discriminating circuit 23.

The outputs of the AND circuits of AND circuit group 13 are fed respectively to the second, day, hour, and minute counters which comprise the time counter 2. The AND circuits of AND circuit group 14 are connected respectively to the day, hour, and minute counters which comprise $M_1$ counter 3. The outputs of the AND circuits of AND circuit group 15 are fed respectively to the day, hour and minute counters which comprises $M_2$ counter 4. The contents of the time counter 2, the first alarm time memory 3 and the second alarm time memory counter 4 are fed respectively to the display change-over circuit 16 and are also fed to a coincidence detecting circuit 19 which generates a coincidence signal if the contents of time counter 2 is the same as the contents of alarm time memory counter 3 or the contents of alarm time memory counter 4.

Out of the contents of the time counter 2 and the alarm time memory counters 3 and 4 fed to the display change-over circuit 16, one content is selectively generated by the signal of the discriminating circuit 23 and displayed on the display device 18 through a decoder driver 17.

In case the coincidence detecting circuit 19 generates a coincidence signal such signal is transmitted through an OR circuit 20 to an alarm driver 21 which is thereby switched to ON condition so as to activate alarm sound generating means 22 to produce an alarm sound.

The output of circuit *7a* is further connected to an inverter input terminal of an AND circuit 24. The outputs of pulse generating circuits *7b* and *7d* are connected to normal input terminals of the AND circuit 24. The output of AND circuit 24 is connected to another input of OR circuit 20. As will be explained below this permits activation of the alarm sound generating means 22 without requiring coincidence between the current time and a preset alarm time.

The operation will now be described with reference to FIG. 1 and the time charts shown in FIG. 2. When switch *5c* alone is closed to ON position the pulse generating circuit *7c* generates a pulse of fixed width each time the switch *5c* is closed. These pulses are fed to the channel selecting shift register 11 which generates a level "1" signal at output W, output $M_1$ or output $M_2$ in accordance with the number of pulses generated by the pulse generating circuit *7c*. Through connection of the outputs W, $M_1$, and $M_2$ to AND circuit groups 13, 14 and 15 the shift register 11 selects from the time counter 2, the $M_1$ counter 3 and the $M_2$ counter 4, the counter the contents of which are to be displayed on the display 18. The signal generated by the shift register 11 is also fed to the discriminating circuit 23 the output of which controls the display change-over circuit 16 so as to display the selected counter content through the decoder driver 17 on the display device 18.

The second reset of the time counter 2 will now be described. When the safety switch *5a* is closed on ON position the output of circuit *7a* is maintained at level "1". The switch *5c* is then pushed as required to step the shift register 11 so as to display the time display. In this condition the output W of the shift register 11 is at level "1" and the other two outputs are at level "0". Hence AND circuit groups 14 and 15 are in OFF position. Moreover since the AND circuit 9 is in OFF condition the three outputs of the shift register 10 are at level "0" and the outputs of AND circuit group 12 are at level "0". As a result the AND circuits *13b*, *13c* and *13d* are in OFF condition. Hence only AND circuit *13a* which is connected to the second counter of the time counter 2 can pass a signal. If the switch *5b* is now pushed a pulse of fixed width is generated by the pulse generating circuit *7b*. This pulse is transmitted through AND circuit 8 and AND circuit *13a* to the time counter 2 to reset the second counter.

In order to reset the alarm memory counters 3 and 4 the switch *5c* is pushed the required number of times to shift the shift register 11 so as to select output $M_1$ for resetting $M_1$ counter 3 or the output $M_2$ for resetting $M_2$ counter 4 as desired. The switch *5b* is then pushed so that pulse generating circuit *7b* generates a pulse which is transmitted through AND circuit 8 and either AND circuit *14a* or AND circuit *15a* according to the selected channel so as to reset the selected alarm time memory counter.

In order to effect a time correction the switch *5a* is closed to ON position as in the former case. Hence the output of circuit *7a* is maintained at level "1". The switch *5c* is then pushed as required to shift the channel selecting shift register 11 so that the output W is at level "1" and the other two outlets are at level "0". If the day counter of time counter 2 is to be corrected the switch *5d* is pushed once. A pulse is thereupon generated from the output of the pulse generating circuit *7d*. This pulse is transmitted through AND circuit 9 to the input of the time unit selecting shift register 10 causing the output A thereof to become level "1" while the other two outputs remain at level "0". The switch *5b* is then pushed the required number of times to effect the desired correction. Each time the switch *5b* is pushed one pulse is generated by the pulse generating circuit *7b* and is transmitted to AND circuit 8 which is thereby closed to ON position so that the pulse is passed through. Since only the output W of the shift register 11 and only the output A of the shift register 10 are level "1" each pulse which passes through the AND circuit 8 is transmitted through AND circuit *12a* and AND circuit *13b* to the day counter of time counter 2. Hence the desired correction of the day counter of time counter 2 is effected by pushing the switch *5b* the required number of times. If the second reset signal is set to be ineffective only the day figure of time counter 2 is corrected.

Similarly in the case of hour and minute correction of the time counter 2 the time unit to be corrected is selected by pushing the switch *5d* the required number of times to shift the time unit selecting shift register 10 to the desired unit. Thus if the hour counter of time counter 2 is to be corrected the shift register 10 is shifted so that the output B is at level "1" while the other outputs are at level "0". If the minute counter of time counter 2 is to be corrected the shift register 10 is shifted so that the output C is at level "1" while the other outputs are at level "0". When the desired time unit has thus been selected the switch 5b is pushed the required number of times to effect the desired correcion. Each time the switch 5b is pushed a pulse is generated by the pulse generating circuit 7b and is transmitted to the time counter 2 through AND circuits 12b and 13c in the case of hour correction and through AND circuits 12c and 13d in the case of minute correction. If the second reset signal is set to be ineffective only the hour or minute correcting signals are effective to make a correction.

The alarm time memory counters 3 and 4 can be set in the same manner. Thus for setting $M_1$ counter 3 the channel selecting shift register 11 is shifted by means of switch 5c so that the $M_1$ output is at level "1" while the other two outputs are at level "0". If the $M_2$ counter 4 is to be set the channel selecting shift register 11 is shifted by means of the switch 5c so that the $M_2$ output is at level "1" and the other two outputs are at level "0". After the alarm time memory counting circuit has been selected the time units of the selected counter are sequentially selected by the time unit selecting shift register 10 by operation of the switch 5d. Pulses generated by the pulse generating circuit 7b upon operation of the switch 5b are then transmitted through AND circuit 8 and the selected AND circuits of AND circuit groups 12 and 14 or 15 to the selected time unit counter of the selected alarm time memory counting circuit to set the alarm time as desired.

When the preset alarm time and the current time of time counter 2 correspond to one another the output of the coincidence detecting circuit 19 becomes level "1" and the level "1" signal switches the alarm driver 21 ON through the OR circuit 20 so as to drive the sound generating means 22.

In accordance with the present invention the same switches of switch group 5 which are used as described above to select the counter the contents of which are to be displayed, to reset the time counter 2 and alarm time memory counting circuits 3 and 4, to correct the count of the time counter 2 and to preset alarm times by the counters 3 and 4 are also used in a different combination to activate the alarm sound generating means 22 in the absence of a coincidence signal being produced by coincidence detecting circuit 19. By way of example the alarm sound generating means 22 can be activated by the switching operation to position switch 5a in OFF position and both of the switches 5b and 5d in ON position.

When the switch 5a is in OFF position the output from the corresponding circuit 7a is at level "0". When the switches 5b and 5d are closed to ON condition a level "1" pulse is generated at the outputs of pulse generating circuits 7b and 7d. The output of the pulse generating circuit 7a is connected to the inverter input terminal of AND circuit 24 while the outputs of pulse generating circuits 7b and 7d are connected to normal input terminals of the AND circuit 24. Therefore when switch 5a is in OFF position and switches 5b and 5d are closed to ON condition the output from AND circuit 24 becomes level "1" and the level "1" pulse is transmitted through the OR circuit 20 to the alarm driver 21 so as to switch the alarm driver 21 ON and thereby activate the alarm sound generating means 22. It is thus possible to activate the alarm sound generator at the discretion of the wearer without requiring the content of time counter 2 to equal the set time of $M_1$ counter 3 or $M_2$ counter 4 so as to generate a coincidence signal in the coincidence detecting circuit 19. Hence the alarm sound generator 22 can be activated as desired, for example to check its operation or to compare the generated sound with that of other watches being considered by a prospective purchaser.

Figure 2:
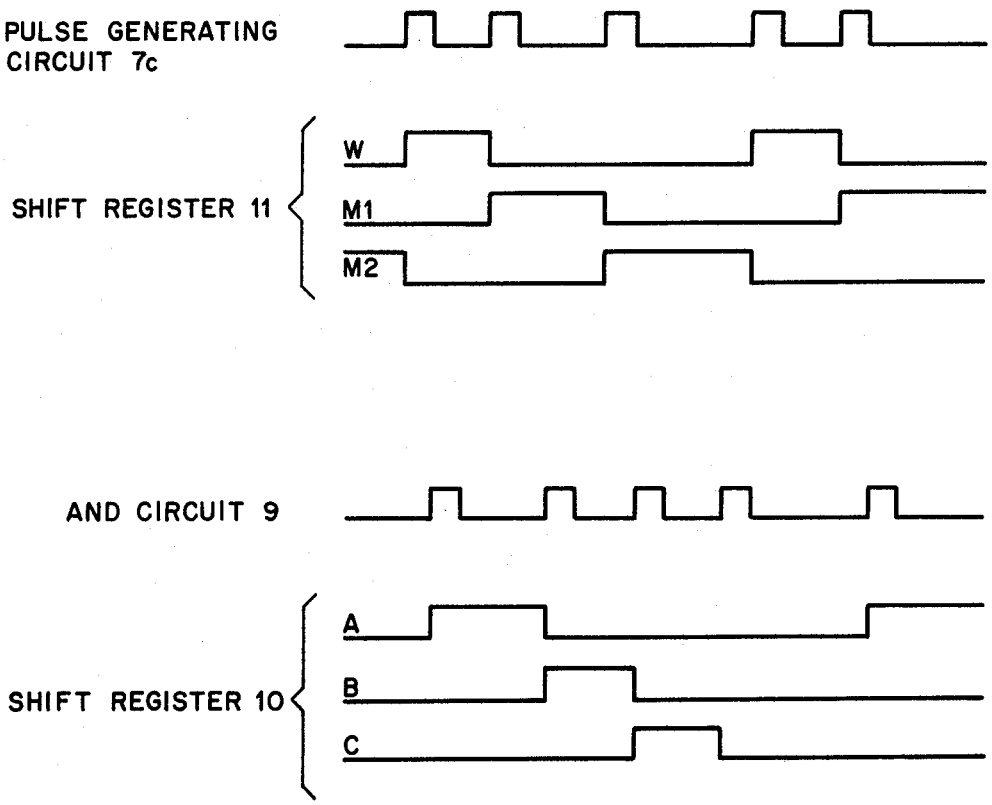

FIG. 2 is a time chart which contributes to an understanding of the operation of the circuitry of FIG. 1 by illustrating how shift register 11 is shifted by pulses generated by the pulse generating circuit 7c upon operation of the switch 5c and how shift register 19 is shifted by pulses generated by the pulse generating circuit 7d upon operation of switch 5d and transmitted through AND circuit 9. It will be understood that for transmission of pulses through AND circuits 8 and 9 the safety switch 5a must be in ON condition while for activating the alarm sound generator 22 by operation of switches 5b and 5d the switch 5a must be in OFF condition.

It will thus be seen that in accordance with the present invention the alarm sound generating means can be activated by a simple switching operation without resetting the alarm time. Therefore a prospective customer can easily try-out different watches to select the one having a preferable alarm sound and the supplier can demonstrate the alarm sounds of different watches quickly and easily. Moreover this capability is achieved without requiring any switches other than those used in normal switching operations of the timepiece, for example in controlling the display, resetting the time counter and alarm counters, correcting the time counter and setting the alarm time counters. Thus the present invention is valuable in many ways.

While a preferred embodiment of the invention has been illustrated in the drawings and is herein particularly described it will be understood that many modifications and variations are possible and that hence the invention is in no way limited to the illustrated embodiments.

What is claimed is:

1. A digital alarm timepiece comprising standard signal generating means, circuit means for frequency-dividing the signal generated by said standard signal generating means, time counting circuit means for counting output signals of said dividing circuit means to provide a time signal, alarm time memory counting circuit means for setting a selected alarm time, display means for selectively displaying the time signal of said time counting circuit means and the set time of said alarm time memory counting circuit means, alarm sound generating means, coincidence circuit means for activating said alarm sound generating means upon occurence of coincidence between the set time of said alarm memory counting circuit means and the time signal of said time counting circuit means, manually operable switching means comprising a plurality of switches operable in selected different combinations to amend the count of said alarm time memory counting circuit means to set an alarm time and to amend the count of said time counting circuit means to correct the time signal provided thereby, each of said alarm time memory counting circuit means and said time counting circuit means comprising a plurality of counters, a first shift register controlled by said switching means to select which of said counting circuit means is to be amended, and a second shift register controlled by said switching means to select which counter of the selected counting circuit means is to be amended.

2. A digital alarm timepiece according to claim 1, in which said switching means comprises means for activating said alarm sound generating means at will independently of said coincidence circuit means.

* * * * *